United States Patent [19]

Robbins et al.

[11] 4,086,548

[45] Apr. 25, 1978

[54] SWITCHABLE ATTENUATOR ASSEMBLY AND METHOD OF ASSEMBLING SAME

[75] Inventors: Theodore W. Robbins; Raymond O. Terry, Jr., both of Winston-Salem, N.C.

[73] Assignee: Western Electric Company, Inc., New York, N.Y.

[21] Appl. No.: 755,396

[22] Filed: Dec. 29, 1976

[51] Int. Cl.[2] ..... H01P 1/22; H01H 19/00; H01H 1/42; H01H 11/00

[52] U.S. Cl. ..... 333/81 R; 200/6 B; 200/16 F; 200/254; 29/622

[58] Field of Search ..... 333/81 A, 81 R; 200/6 BB, 6 B, 6 C, 11 D, 16 F, 254; 338/172, 173; 29/622

[56] References Cited

U.S. PATENT DOCUMENTS

| | | | |
|---|---|---|---|
| 368,221 | 8/1887 | McDaniel | 200/254 |
| 1,751,398 | 3/1930 | Reamer et al. | 200/6 B |
| 1,919,039 | 7/1933 | Ritchie | 200/15 |
| 2,791,647 | 5/1957 | Newcomb | 200/16 B |

*Primary Examiner*—Alfred E. Smith
*Assistant Examiner*—Harry E. Barlow
*Attorney, Agent, or Firm*—J. B. Hoofnagle, Jr.; D. D. Bosben

[57] ABSTRACT

A switchable attenuator includes a split housing assembly formed of interlocking cover and support members. A plurality of rocker arms are mounted for pivotable movement between the cover and the support members and each rocker arm has lugs formed on opposite ends thereof which receive respective ones of a pair of shorting bars. Electrical circuit connectors, coupled to an attenuator circuit mounted adjacent to the support member, are aligned in pairs with each pair being positioned to receive a respective one of the pair of shorting bars associated with each rocker arm. The rocker arms are selectively pivoted to cause the shorting bars to move into and out of engagement with the electrical circuit connectors aligned therewith to selectively provide attenuation of different magnitudes to an external circuit.

20 Claims, 6 Drawing Figures

SWITCHABLE ATTENUATOR ASSEMBLY AND METHOD OF ASSEMBLING SAME

BACKGROUND OF THE INVENTION

1. Field of the Invention

This invention relates to a switchable attenuator and to a method of assembling same. More particularly, this invention relates to a switchable attenuator utilizing a split housing assembly formed of interlocking cover and support members, for providing attenuation to an external circuit and to a method of assembling the same.

2. Description of the Prior Art

In prior art attenuator structures, it has been common to provide attenuation to an external circuit utilizing a slideable attenuator assembly. The slideable attenuator assembly ordinarily includes a slideable arm having conductive contact members at each end thereof. The conductive contact members on each end of the slideable arm are selectively engageable with switching contact pads, connected to circuits on an attenuator circuit substrate, to complete circuit paths between circuits on the attenuator circuit substrate and thereby provide attenuation in the external circuitry. The very nature of the slideable attenuator assembly design requires that the conductive members and contact pads be engageable on the planar surface of the attenuator circuit substrate. As a result, a large amount of space is required in the plane of the circuit to accommodate switching.

In addition, utilizing this arrangement makes it necessary to provide switching contact pads which are made of conductive materials which insure very high reliability. Materials of this nature are required to insure the integrity of the electrical connections established between the conductive contact members on the slideable arm and the switching contact pads. This requirement is most often satisfied by utilizing very precious conductive materials to form the switching contact pads such as, for example, gold and/or rhodium. The space requirements and the quantity of precious conductive materials that must be used results in an expensive attenuator structure. Accordingly, it is desirable to provide a reliable attenuator structure which does not require the space and quantity of conductive materials required in manufacturing the aforementioned attenuator structure.

SUMMARY OF THE INVENTION

A switchable attenuator, in accordance with this invention, for providing different magnitudes of attenuation to an external circuit includes a cover having an opening formed therein and a support aligned with and coupled to the cover. Means captured for movement between the cover and support has portions extending into the opening in the cover and other portions for coupling selected circuits on a circuit means to the external circuit. A plurality of connector means are provided with each having a first portion electrically securable to the circuit means. The plurality of connector means have second portions aligned to receive portions of the coupling means for providing connections between the circuit means and the coupling means.

Upon selective movement of the coupling means to engage the second portions of selected ones of the plurality of connector means, selected circuits on the circuit means are coupled to the external circuit to establish predetermined amounts of attenuation. The plurality of connector means include third portions electrically securable to the external circuit for providing connections between the circuit means and the external circuit so that the predetermined amounts of attenuation established in the circuit means are provided to the external circuit.

A method of assembling a switchable attenuator in accordance with this invention includes the steps of (1) attaching a conductive element to a movable member; (2) positioning the movable member on a support; (3) coupling a cover to the support to capture the movable member between the cover and support with portions of the movable member extending into an opening in the cover; and (4) assembling a connector of a circuit means with the cover so that the connector is in alignment with the conductive element attached to the movable member.

BRIEF DESCRIPTION OF THE DRAWINGS

Advantages of the present invention will be apparent from the following detailed description when considered in conjunction with the accompanying drawings in which.

DETAILED DESCRIPTION

Figure 1:
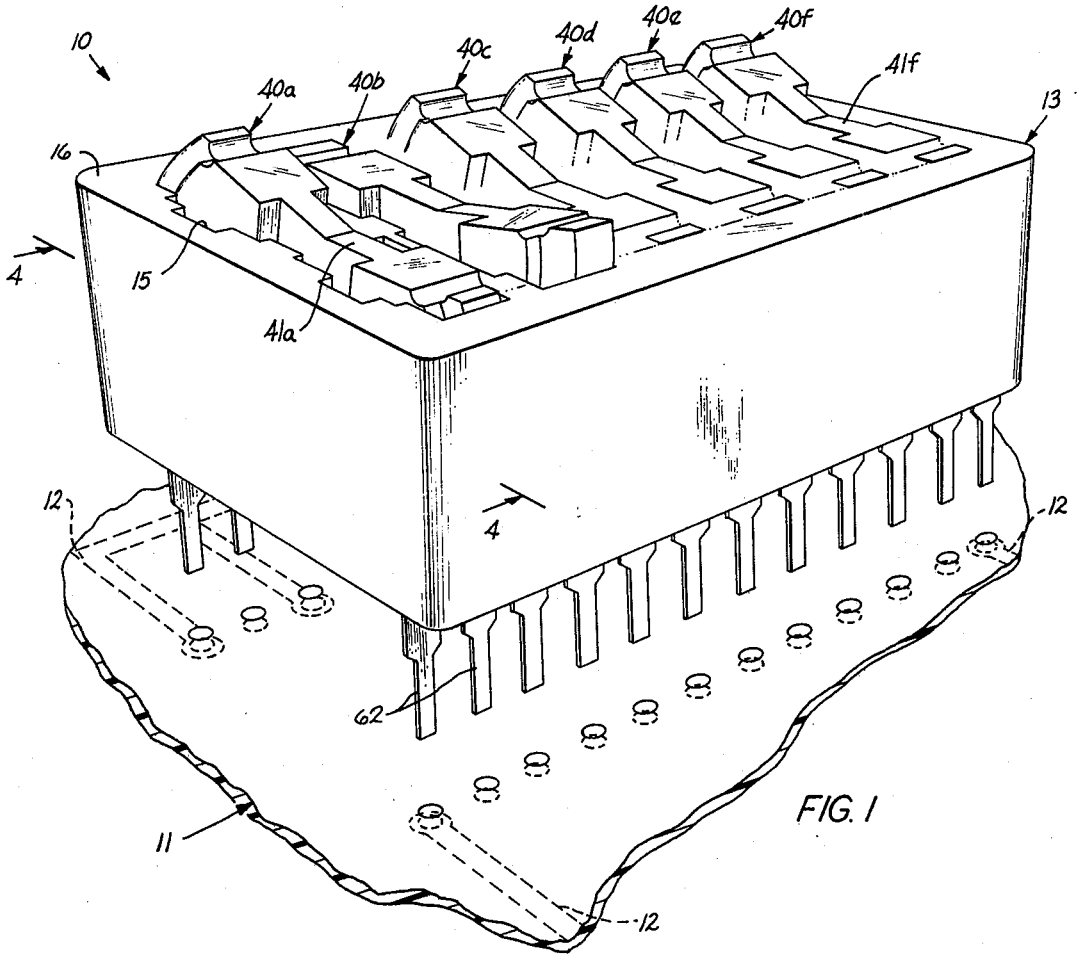
FIG. 1 is an enlarged isometric view of an attenuator embodying principles of the invention.

Referring to FIG. 1, a switchable attenuator assembly, generally designated by the numeral 10, is designed to be electrically coupled to an external circuit (not shown) contained on, for example, a printed circuit board generally designated by the numeral 11. The printed circuit board 11 has conductive paths 12—12 formed thereon which are coupled to circuitry (not shown) included on the printed circuit board.

This invention is related to a priorly conceived attenuator assembly disclosed in a copending application entitled "Switchable Attenuator," Ser. No. 755,397, which was filed concurrently herewith in the names of J. G. Nance et al., and assigned to the same assignee. The attenuator assembly disclosed in the above-mentioned application of J. G. Nance et al. includes a housing, a plurality of rocker arms mounted for pivotable movement within the housing, and a pair of shorting bars associated with each rocker arm. A shorting bar is coupled to each end of each of the rocker arms and aligned with electrical connectors which extend from an attenuator circuit aligned adjacent to the housing. Each rocker arm is pivotable to cause the shorting bar coupled to a downwardly pivoted end thereof to move into engagement with electrical connectors aligned therewith to selectively provide attenuation to an external circuit.

Figure 4:
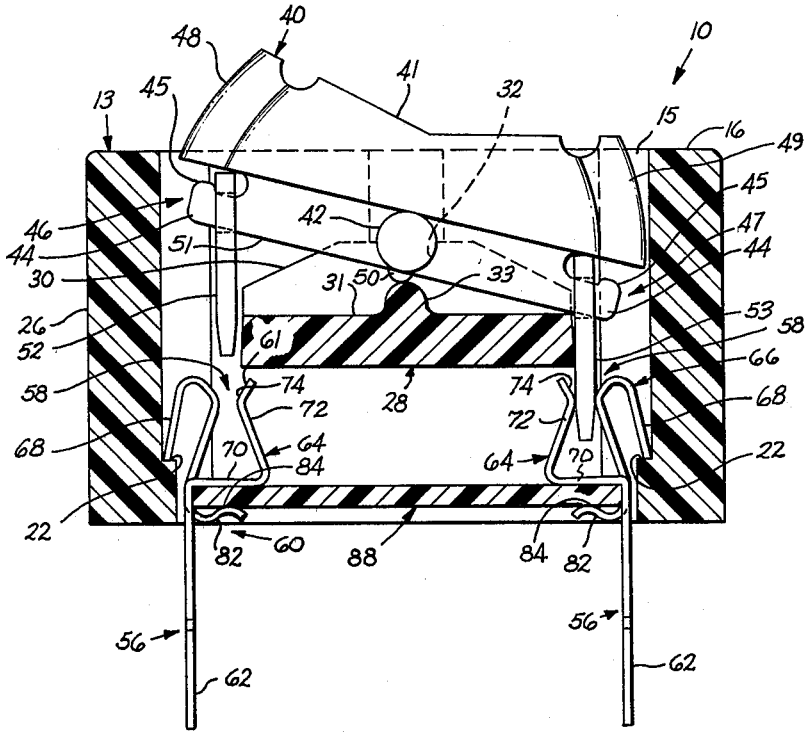
FIG. 4 is a cross-sectional view of the attenuator taken along the line 4—4 in FIG. 1.
Figure 2:
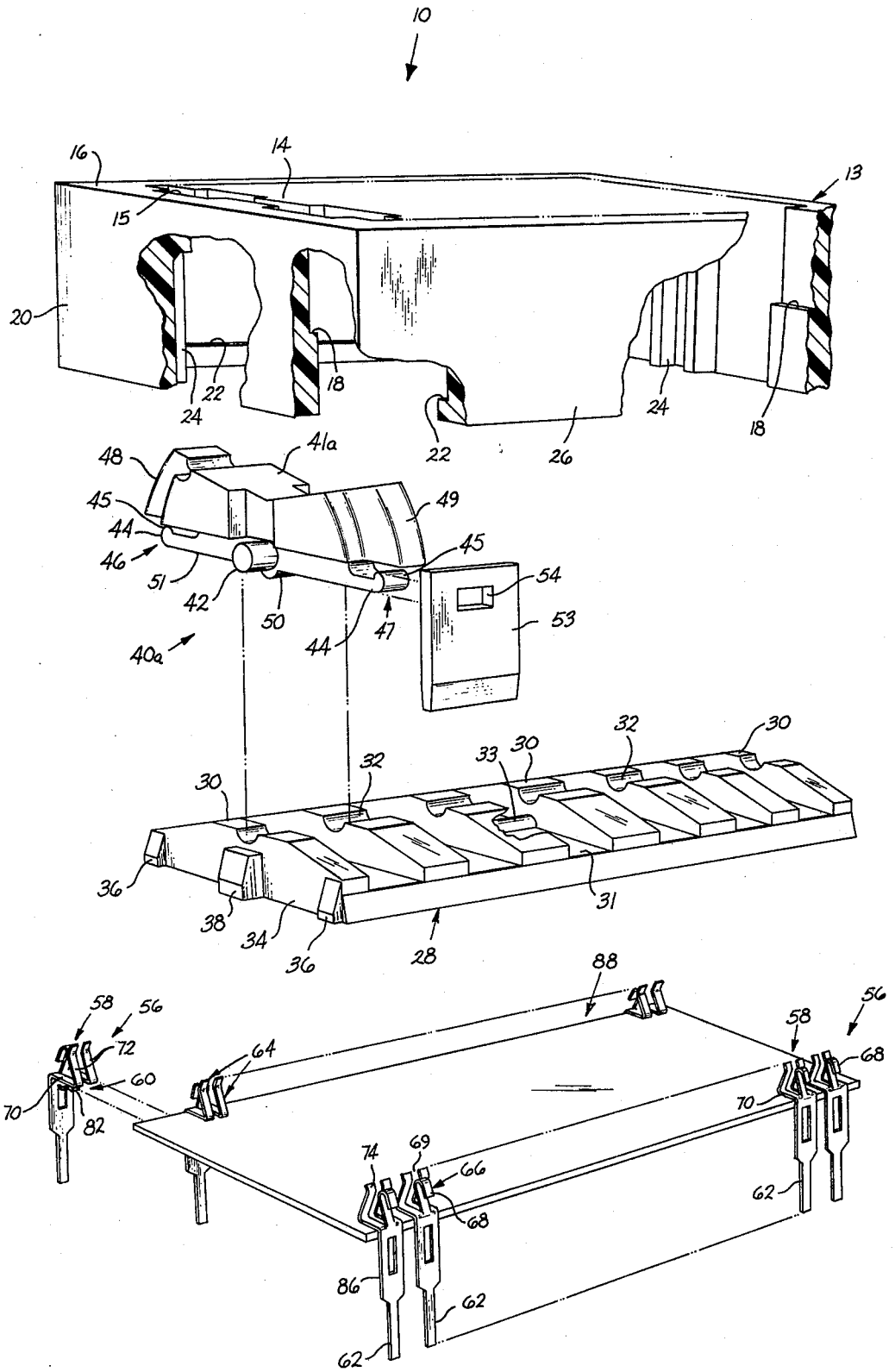
FIG. 2 is an exploded isometric view of portions of the attenuator illustrated in FIG. 1 with parts broken away for clarity.
Figure 5:
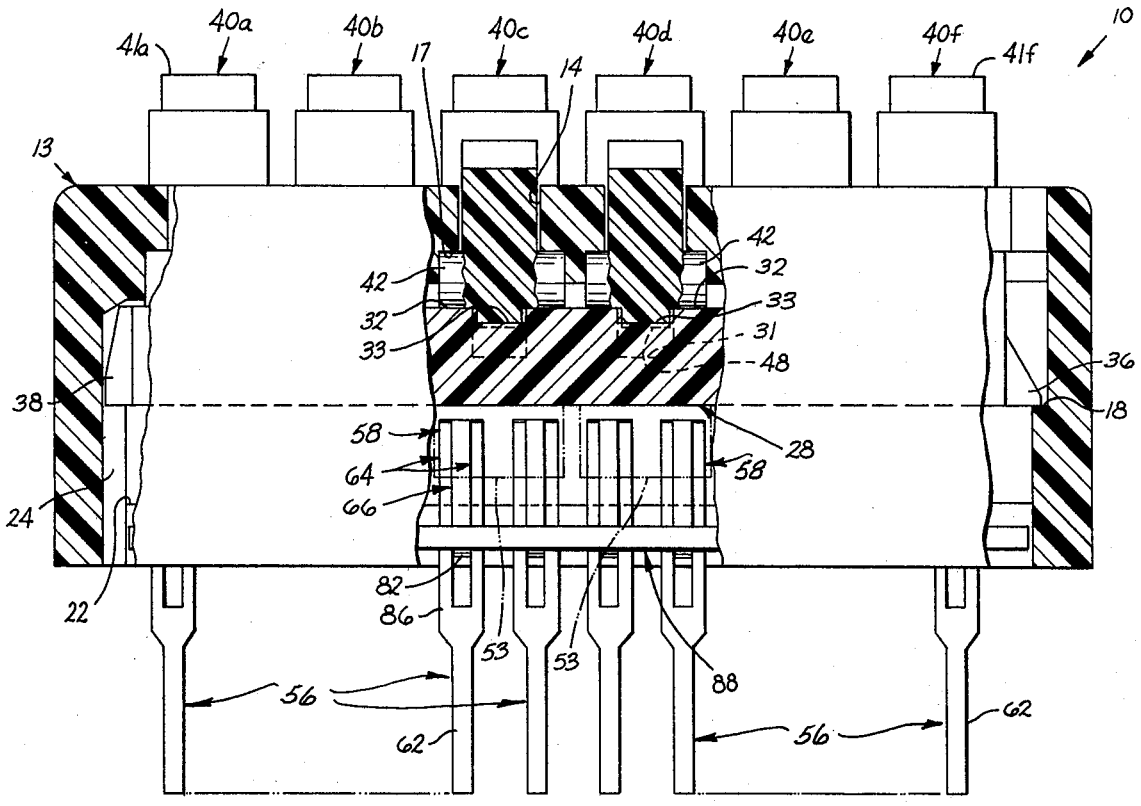
FIG. 5 is a side elevation view of the attenuator assembly illustrated in FIG. 1, with parts broken away for clarity.

As is illustrated in FIGS. 2 and 5, the switchable attenuator assembly 10, embodying the principles of this invention, includes a housing or cover, generally designated by the numeral 13, having a plurality of spaced partitions 14 formed thereon to provide a plurality of openings 15—15 in an upper portion 16 of the cover. A plurality of spaced inverted semicylindrical seats 17 (FIG. 5) are formed on the underside of the upper portion 16 of the cover. Each of two end walls 20 of the cover 13 is formed internally with a pair of spaced support ledges 18. Each of two side walls 26 of the cover 13 is formed internally with a support ledge 22 (FIGS. 2 and 4) which extends longitudinally thereof. A guide slot 24 is formed inside each opposite end wall 20 of the cover 13.

Referring to FIG. 2, a support member, generally designated by the numeral 28, is provided in the attenuator assembly 10, and includes a plurality of partitions 30—30 which are formed on a top surface 31 of the support member. A semicylindrically shaped bearing surface 32 is formed in each of the partitions 30 of the support member 28. Projections 33 (only one shown), which extend from intermediate portions of the top surface 31 of the support member 28, are provided between each pair of partitions 30—30. The support member 28 has at each end 34 (one shown) thereof a pair of spaced wedge-shaped resilient corner latches 36 and a guide 38 centrally located therebetween.

The guide 38 at each end 34 of the support member 28 is insertable into the corresponding guide slot 24 in the cover 13 as the support member is positioned adjacent the cover. As a result of the guides 38 being positioned and retained in the slots 24, the support member 28 will be maintained in proper alignment adjacent the cover 13. As the guides 38 are pushed into the respective guide slots 24, the resilient latches 36 are compressed as they move against the inside of the end walls 20 of the cover 13 until they ride above the ledges 18 at which time they expand and come to rest on the ledges. Once the latches 36 come to rest on the ledges 18, as will be explained, the support member 28 is captured in the cover 13 between the ledges 18 and the underside of the cover resulting in an interlocking of the cover and support member.

A plurality of rocker arms, generally designated by the numerals **40*a*–40*f* (FIGS. 1 and 5), are provided in the attenuator assembly 10 with top portions 41*a*–41*f*, respectively, thereof designed to extend into corresponding ones of the openings 15 in the cover 13. The rocker arms 40*a*–40*f* are identical in structure, for example, as illustrated in FIG. 2 with respect to rocker arm 40*a*. Rocker arm 40*a* includes a shaft 42 formed integrally therewith and projecting from opposite sides thereof, which is aligned to rest in corresponding ones of adjacent bearing surfaces 32 in the support member 28. A pair of lugs 44 having raised lip portions 45 are formed integrally with and extend laterally from opposite ends, generally designated by the numerals 46 and 47, of the rocker arm 10*a*. Overhanging ends 48 and 49 of the rocker arm 40*a* are spatially located above the lugs 44. An abutment or projection 50 (FIG. 2) is formed on a bottom surface 51 of the rocker arm 40*a*. The abutment 50 will engage a corresponding one of the projections 33 on the support member 28 so that upon movement of the rocker arm 40*a* the abutment will be moved to ride on and engage portions of the projection on each side of the center of the projection. As a result, when the abutment 50 moves over the center of the projection 33 to engage the portion on either side thereof, the movement of the rocker arm 40*a*** is forestalled until a pressure is applied to move the rocker arm in the other direction, and thus detented pivotable movement of the rocker arm on the support member is accomplished.

Conductive shorting bars or blades 52 (FIG. 4) and 53 (FIGS. 2 and 4), are formed with openings 54. The openings 54 of the shorting bars 52 and 53 are provided to receive, by way of example, the lugs 44 of the rocker arm **40*a* so that the shorting bars can rest on the lugs and be seated on each end of the rocker arm. Once the shorting bars 52 and 53 are seated on the rocker arm 40*a*, the raised lips 45 of the lugs 44 will preclude the shorting bars from sliding off the lugs. The shorting bars 52 and 53** may also be plated with another conductive material, such as, for example, gold, to enhance the electrical coupling and wear capabilities of the shorting bars.

As illustrated in FIG. 2, a plurality of dual clip electrical connectors, generally designated by the numerals 56, are provided for facilitating electrical coupling in the attenuator assembly 10. A connector of this type also is disclosed in the copending application entitled "Dual Clip Connector," Ser. No. 755,399, which was filed concurrently herewith in the name of J. L. Owens and which is assigned to the same assignee.

Figure 3:
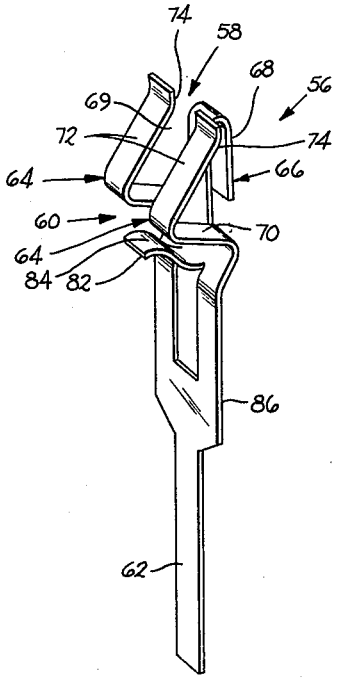
FIG. 3 is an isometric view illustrating a connector embodying certain principles of the invention.

Referring to FIG. 3, each connector 56 is formed of a conductive material such as, for example, a copper-nickel alloy and includes first and second electrical clips, generally designated by the numerals 58 and 60, respectively, and a conductive stem 62.

The first clip 58 includes a pair of spaced resilient side fingers, generally designated by the numeral 64, located in a first plane and an opposed central finger, generally designated by the numeral 66, located in a second plane spaced from the first plane. The central finger 66 is also formed with an outwardly turned retaining hook 68. The central finger 66 is aligned with and spaced from a space 69 between the pair of resilient fingers 64. Each of the resilient fingers 64 includes a portion, generally designated by the numeral 70, which extends laterally from the plane of the stem 62 at an upper end thereof and another portion, generally designated by the numeral 72, which extends generally upwardly from the portion 70 with the upper end thereof angled toward the plane of the stem 62. Outwardly turned free ends 74 of the upwardly extending portions 72 can have a highly conductive material, such as, for example, gold, placed on the inner surfaces thereof to provide contact pads which will enhance electrical coupling. The central finger 66 cooperates with the upwardly extending portions 72 of the fingers 64 to receive and retain a respective one of the shorting bars 52 or 53 (FIG. 4) therebetween. The retaining hook 68 of the central finger 66 is provided to cooperate with the support ledges 22 (FIG. 4) of the cover 13 to retain the connector 56 in the cover.

A resilient finger, generally designated by the numeral 82 (FIG. 3), is formed and extends laterally from the intermediate portion of the stem 62 of each connector 56 and includes a contact surface 84. The laterally extending finger 82 cooperates with the underside of the laterally extending portions 70 of the pair of fingers 64 to form the second electrical clip 60.

Figure 6:
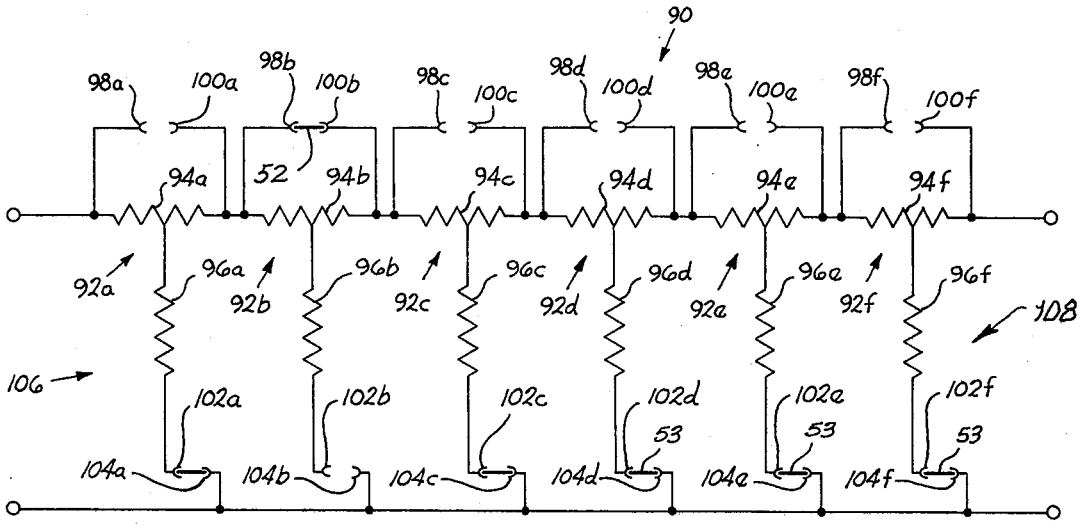
FIG. 6 is a circuit schematic illustrating a circuit included on a circuit substrate.

Referring to FIGS. 2 and 4, a circuit substrate device, generally designated by the numeral 88, included in the attenuator assembly 10, provides predetermined amounts of attenuation to the external circuit supported on the printed circuit board 11 (FIG. 1). The circuit substrate device 88 may be constructed utilizing discrete components, or fabricated utilizing printed circuit techniques, thin film circuit technology or any other well-known circuit fabrication techniques. The underside of the circuit substrate device 88 (FIG. 4) includes a circuit, generally designated by the numeral 90 as illustrated in FIG. 6. The circuit 90 includes a plurality of resistive T-networks, generally designated by the numerals 92*a*–92*f*, which are each for providing designated amounts of attenuation at a predetermined impedance. The amount of attenuation provided by each of the resistive T-networks 92*a*–92*f* will depend on the value of the resistors 94*a*–94*f* and 96*a*–96*f*, included in each resistive T-network.

Connectors 56 can be coupled to the circuit substrate 88 via the electrical clips 60 as is illustrated in FIGS. 2 and 4. The contact surfaces 84 of the connectors 56 are located so as to electrically engage respective circuit nodes 98*a*–98*f*, 100*a*–100*f*, 102*a*–102*f* and 104*a*–104*f* (FIG. 6) of each resistive T-network 92*a*–92*f*. The conductive stems 62 of the connectors 56 are coupled to corresponding conductive pads 12 (FIG. 1) on the external circuit. This connects input 106 and output 108 (FIG. 6) of the circuit 90 to the external circuit so that selected amounts of attenuation can be provided thereto.

A method of assembling the attenuator assembly 10 can be understood by referring to FIGS. 2, 3 and 4. A pair of the shorting bars 52 and 53 are first assembled on the respective lugs 44 at each end 46 and 47 of each of the rocker arms 40*a*–40*f* as indicated previously. The rocker arms 40*a*–40*f* are then positioned on the support member 28 by placing the shafts 42 of the rocker arms in corresponding ones of the bearing surfaces 32 formed in the partitions 30 so that the projections 50 on the rocker arms will engage corresponding projections 33 on the support member. The circuit substrate 88 with the connectors 56 assembled therewith is then aligned adjacent the support member 28 so that the shorting bars 52 and 53 associated with the ends 46 and 47, respectively, of the rocker arms 40*a*–40*f* will be aligned to engage corresponding ones of the clips 58 of the adjacent pairs of connectors 56 (FIG. 5) which are coupled to the nodes (FIG. 6) 98*a*–98*f*, 100*a*–100*f*, 102*a*–102*f* and 104*a*–104*f* of the circuit 90. Once the rocker arms 40*a*–40*f* have been positioned on the support member 28, the guides 38 of the support member are inserted into their corresponding guide slots 24 in the cover 13 until the top portions 41*a*–41*f* of the rocker arms extend into their corresponding openings 15 in the cover and until the resilient latches 36 ride above and rest on the support ledges 18 on the cover. This results in the upper portions of the shafts 42 of each of the rocker arms 40*a*–40*f* seating in the inverted semicylindrical seats 17 in the cover 13 with the shorting bars 52 and 53 being disposed inside the cover as shown in FIG. 4. Additionally, the shafts 42 of the rocker arms 40*a*–40*f* will be captured for rotational movement between the support member 28 and cover 13 and the support member will be captured and locked in place in the cover. The retaining hooks 68 of the connectors 56, coupled to the circuit substrate 88, are then positioned to engage and rest on corresponding portions of the ledges 22 of the cover 13 to assemble the connectors and the circuit substrate with the cover. As a result, the pairs of connectors 56 will be aligned to receive the appropriate shorting bars 52 and 53 which are coupled to the respective rocker arms 40*a*–40*f*.

When a desired amount of attenuation is to be provided to the external circuit 12, the appropriate ones of the rocker arms 40*a*–40*f* of the attenuator assembly 10 must be selectively positioned. For example, when the rocker arm 40*a* illustrated in FIGS. 1 and 4 is pivoted in the direction indicated, the associated shorting bar 53 (FIG. 4) coupled to the downwardly pivoting end 47 will engage the pair of clips 58 of the pair of connectors 56 aligned therewith and coupled to the nodes 102*a* and 104*a* (FIG. 6) of the resistive T-network 92*a*. At the same time, the shorting bar 52 on the end 46 of the rocker arm 40*a* disengages from the clips 58 of the pair of connectors 56 coupled to the nodes 98*a* and 100*a* (FIG. 6). This will establish a connection between the nodes 102*a* and 104*a* thereby establishing a current path through a portion of the resistor 94*a* and the resistor 96*a* to the external circuit by virtue of connections to the input 106 and output 108 of the circuit 90. As a result, a predetermined amount of attenuation will be provided in the external circuit with respect to T-network 92*a*. Similarly, when each of the remaining rocker arms 40*b*–40*f* are pivoted in the same direction as the rocker arm 40*a*, the associated shorting bar 53 coupled to the downwardly pivoting end 47 of each of the rocker arms establishes a connection between the corresponding nodes 102*b*–102*f* and 104*b*–104*f* associated therewith to thereby provide predetermined amounts of attenuation to the external circuit.

Attenuation can be removed from the external circuit by pivoting the rockers 40*a*–40*f* in the other direction, such as, for example, as is illustrated by the rocker arm 40*b* (FIG. 1). Pivoting of the rocker arm 40*b*, as illustrated, will open the connection between the nodes 102*b* and 104*b* (FIG. 6) by removing the shorting bar 53 from engagement with associated clips 58 while simultaneously causing the shorting bar 52 coupled to the end 46 of the rocker arm to engage the clips 58 of the connectors 56 coupled to the nodes 98*b* and 100*b*. This will short out the resistor 94*b* of the resistive T-network 92*b* as well as open the circuit leg containing the resistor 96*b*. As a result, attenuation provided by the resistive T-network 92*b* will be removed from the external circuit. The other rocker arms 40*a* and 40*c*–40*f* may be pivoted in a similar manner to remove from the external circuit the respective amounts of attenuation provided by the resistive T-networks 92 associated therewith.

It should be understood that additional amounts of attenuation can be provided to the external circuit by including additional resistive T-networks such as T-network 92*a* in the circuit 90 and providing the corresponding structural components that are required.

The split-housing assembly disclosed herein permits assembly of the shorting bars 52 and 53 with the rocker arms 40*a*–40*f* prior to the interlocking of the support member 28 to the cover 13. In addition, the circuit substrate 88 is supported in the bottom of the cover 13 in such a manner as to provide a protective enclosure for the circuit substrate. The circuit substrate 88 having connectors 56 associated therewith when held in the cover 13 (FIG. 4) by the connectors along opposite edges of the substrate, exerts a sufficient force on the connectors to guarantee that they will be properly positioned and aligned with the shorting bars 52 and 53 within the assembly.

It should also be understood that the above-described embodiments of the invention described herein is simply illustrative of this invention and that other embodiments thereof may be devised by those skilled in the art which will embody the principles of this invention an fall within the spirit and scope thereof.

What is claimed is:

1. An attenuator for providing attenuation to an external circuit comprising:

circuit means having circuits formed thereon for establishing attenuation in the external circuit;

a cover having an opening formed therein;

a support member aligned with and coupled to the cover;

means, captured for movement between the cover and the support member and having portions extending into the opening in the cover and other portions adjacent to the circuit means, for coupling selected circuits on the circuit means;

a plurality of connector means;

each of the plurality of connector means having a first portion electrically securable to the circuit means for providing connections to the circuits on the circuit means;

each of the plurality of connector means having second portions aligned to receive portions of the coupling means for providing connections between the circuit means and the coupling means so that, upon selected movement of the coupling means to engage the second portion of selected ones of the plurality of connector means, selected circuits on the circuit means are coupled to establish predetermined amounts of attenuation; and each of the plurality of connector means having a third portion selected ones of which are electrically securable to the external circuit for providing connections between the circuit means and the external circuit so that the predetermined amounts of attenuation established in the circuit means are provided to the external circuit.

2. An attenuator as defined in claim 1 wherein the coupling means includes a rocker arm captured for movement between the cover and support member with first portions thereof extending into the opening in the cover and second portions thereof for engaging the second portions of the corresponding connector means and for coupling selected circuits on the circuit means upon selected movement of the rocker arm.

3. An attenuator as defined in claim 2 wherein the second portions of the rocker arm include at least one conductive shorting bar.

4. An attenuator as defined in claim 2 wherein the second portions of the rocker arm include a pair of shorting bars with each bar of the pair of shorting bars being coupled to a respective end of the rocker arm.

5. An attenuator as defined in claim 1 wherein:

the first portion of each of the plurality of connector means includes a first electrical clip;

the second portion of each of the plurality of connector means includes a second electrical clip; and the third portion of each of the plurality of connector means includes an electrical stem which is coupled to the first and second electrical clips.

6. An attenuator as defined in claim 5 wherein the first electrical clip includes portions forming a part of the second electrical clip.

7. An attenuator as defined in claim 6 wherein the connector means includes an intermediate portion and the first electrical clip includes a laterally extending finger formed on the intermediate portion.

8. An attenuator as defined in claim 7 wherein the second electrical clip of each connector means includes a pair of upwardly extending side finger portions and a central finger aligned with a space between the upwardly extending side finger portions; the central finger and the upwardly extending side finger portions cooperating to receive portions of the coupling means to provide connections between the circuit and the coupling means.

9. An attenuator as defined in claim 8 wherein the second electrical clip further includes a pair of laterally extending finger portions coupled to and supporting the upwardly extending finger portions, and wherein the pair of laterally extending finger portions cooperate with the laterally extending finger formed on the intermediate portion of the connector means to provide connections to circuits on the circuit means.

10. An attenuator as defined in claim 1 wherein the circuits on the circuit means include a resistive T-circuit network which provides designated amounts of attenuation at a predetermined impedance.

11. An attenuator for providing attenuation to an external circuit comprising:

circuit means having circuits formed thereon for establishing attenuation in the external circuit;

a cover having an opening formed therein;

a support member aligned with and coupled to the cover;

a rocker arm captured for movement between the cover and the support member and having upper portions extending into the opening in the cover;

a pair of conductive shorting bars with each bar being coupled to a respective end of the rocker arm for coupling selected circuits on the circuit means;

a plurality of connectors;

each of the plurality of connectors including first and second upwardly extending side finger portions, first and second laterally extending finger portions coupled to and supporting the first and second upwardly extending side finger portions, and a central finger aligned with a space between the first and second upwardly extending side finger portions and cooperating therewith to receive respective ones of the conductive shorting bars and thereby provide connections between the circuit means and the shorting bars;

each of the plurality of connectors including a laterally extending finger formed on an intermediate portion of the connector which cooperates with portions of the first and second laterally extending finger portions to receive and retain the circuit means and provide connections to the circuits on the circuit means so that upon selective movement of the rocker arm selected circuits on the circuit means are coupled to and establish predetermined amounts of attenuation; and each of the plurality of connectors including a conductive stem selected ones of which provide connections between the circuit means and the external circuit so that the predetermined amounts of attenuation established in the circuit means are provided to the external circuit.

12. An attenuator as defined in claim 11 wherein the circuits on the circuit means include a resistive T-circuit network which provides designated amounts of attenuation at a predetermined impedance.

13. An attenuator as defined in claim 11 further comprising:

means for providing detented movement of the rocker arm.

14. An attenuator as defined in claim 11 wherein the connectors are in assembly with opposite inside portions of the cover and in assembly with opposite sides of the circuit means, the circuit means exerting a force on the connectors to hold the connectors in assembly with the cover and in alignment to receive the shorting bars.

15. A method of assembling a switchable attenuator comprising the steps of:

attaching conductive elements to an electrically insulating movable member;

positioning the movable member in alignment with an electrically insulating support member and an electrically insulating cover member;

coupling the cover member to the support member to capture the movable member between the cover member and the support member with portions of the movable member extending into an opening in the cover member and with the conductive elements disposed inside the cover member; and assembling connectors of a circuit means with the cover member and in alignment with the conductive elements attached to the movable member.

16. A method of assembling an attenuator as defined in claim 15 wherein the movable member includes a rocker arm, and the conductive elements includes a pair of shorting bars and wherein the attaching step includes:

coupling each bar of the pair of shorting bars to a respective end of the rocker arm.

17. A method of assembling an attenuator as defined in claim 16 wherein the positioning step includes:

positioning the rocker arm on the support member to provide for pivotable movement of the rocker arm on the support.

18. A method of assembling an attenuator as defined in claim 15 wherein the assembling step includes:

assembling an electrical clip of each of the connectors onto the circuit means to electrically couple the circuit means to the connector; and positioning a retaining hook formed on each of the connectors coupled to the circuit means in engagement with a portion of the cover member in alignment with the conductive elements attached to the movable member.

19. A method of assembling an attenuator as defined in claim 18 wherein the electrical clip is a first electrical clip and wherein the assembling step further includes positioning the connectors in engagement with the cover member with a second electrical clip of each of the connectors in alignment with one of the conductive elements attached to the movable member and an electrical stem of each of the connectors extending downwardly externally of the cover member.

20. A method of assembling an attenuator comprising the steps of:

attaching each one of a pair of shorting bars to a respective end of an electrically insulating rocker arm;

positioning the rocker arm in alignment with an electrically insulating support member and an electrically insulating cover member;

coupling the cover member to the support member to capture the rocker arm between the cover member and support member for pivotable movement with portions of the rocker arm extending through an opening in the cover member and with the shorting bars disposed inside th cover member;

coupling a first electrical clip of a plurality of connectors to opposite sides of a circuit means to electrically couple the circuit means to the connector; and positioning a retaining hook formed on each of the connectors of the circuit means in engagement with oppositeinside portions of the cover member with the circuit means exerting a force on the connectors to hold the connectors in place so that a second electrical clip of each of the plurality of connectors will be aligned to receive one of the shorting bars attached to the rocker arm and so that an electrical stem of each of the plurality of connectors extends downwardly externally of the cover member.

* * * * *